US011577308B2

(12) United States Patent
Park

(10) Patent No.: US 11,577,308 B2
(45) Date of Patent: Feb. 14, 2023

(54) DIE CASTING APPARATUS PROVIDED WITH MOVABLE ELECTROMAGNETICALLY CONTROLLED STRUCTURE CONTROL MODULE

(71) Applicant: FUTURECAST CO., LTD., Hwaseong-si (KR)

(72) Inventor: Tae Yoon Park, Incheon (KR)

(73) Assignee: FUTURECAST CO., LTD., Hwaseong-si (KR)

( * ) Notice: Subject to any disclaimer, the term of this patent is extended or adjusted under 35 U.S.C. 154(b) by 0 days.

(21) Appl. No.: 17/288,413

(22) PCT Filed: Oct. 22, 2019

(86) PCT No.: PCT/KR2019/013917
§ 371 (c)(1),
(2) Date: Apr. 23, 2021

(87) PCT Pub. No.: WO2020/085775
PCT Pub. Date: Apr. 30, 2020

(65) Prior Publication Data

US 2021/0379650 A1 Dec. 9, 2021

(30) Foreign Application Priority Data

Oct. 24, 2018 (KR) ..... 10-2018-0128530
Mar. 29, 2019 (KR) ..... 10-2019-0038128

(51) Int. Cl.
*B22D 17/30* (2006.01)
*B22D 17/20* (2006.01)

(52) U.S. Cl.
CPC ..... *B22D 17/30* (2013.01); *B22D 17/2023* (2013.01); *B22D 17/2038* (2013.01)

(58) Field of Classification Search
CPC ..... B22D 17/20; B22D 17/2023; B22D 17/2038; B22D 17/30; B22D 17/2015; B22D 17/32
(Continued)

(56) References Cited

U.S. PATENT DOCUMENTS 5,025,853 A 6/1991 Schmid
5,579,825 A * 12/1996 Shibata et al. ..... B22D 17/2038 164/493
(Continued)

FOREIGN PATENT DOCUMENTS

KR 10-0436118 B1 6/2004
KR 10-0554093 B1 2/2006
(Continued)

*Primary Examiner* — Kevin P Kerns
(74) *Attorney, Agent, or Firm* — Maschoff Brennan

(57) ABSTRACT

Disclosed is a die casting apparatus including a movable die provided with a forming space; and a lower fixed die which corresponds to the movable die and accommodates molten metal, and includes a sleeve into which the molten metal is injected, wherein the molten metal is cast into a formed object by bringing the movable die and the lower fixed die into contact with each other. The die casting apparatus is provided with a movable electromagnetically controlled structure control module including at least one electromagnetic stirring device-accommodating part that accommodates an electromagnetic stirring device therein and is configured to pass through the lower fixed die to the vicinity of the sleeve in order to electromagnetically stir the molten metal injected through the sleeve.

3 Claims, 12 Drawing Sheets

(58) Field of Classification Search
USPC ..... 164/147.1, 499, 303, 312, 113
See application file for complete search history.

(56) References Cited

U.S. PATENT DOCUMENTS

| | | | |
|---|---|---|---|
| 2004/0211540 | A1 | 10/2004 | Hong et al. |
| 2005/0167073 | A1 | 8/2005 | Hong |
| 2013/0192791 | A1 | 8/2013 | Takahashi |

FOREIGN PATENT DOCUMENTS

| | | | |
|---|---|---|---|
| KR | 10-0662034 | B1 | 12/2006 |
| KR | 10-2011-0102661 | A | 9/2011 |
| KR | 10-1253605 | B1 | 5/2012 |
| KR | 10-2013-0009240 | A | 1/2013 |

* cited by examiner

DIE CASTING APPARATUS PROVIDED WITH MOVABLE ELECTROMAGNETICALLY CONTROLLED STRUCTURE CONTROL MODULE

TECHNICAL FIELD

The present disclosure relates to a die casting apparatus, and more particularly, to a die casting apparatus having a movable electromagnetically controlled structure control module that can be withdrawn to the outside and is arranged adjacent to a sleeve.

BACKGROUND ART

A die casting apparatus includes a die including a movable die and a fixed die, and a sleeve connected to an inside of the die to form an injection path for molten metal. When the movable die and the fixed die are brought into contact with each other, a casting space is formed, and a cast article may be manufactured by pushing molten metal in the sleeve into the casting space by a plunger and press-fitting the same into the casting space.

Methods to perform structure control for such a die casting apparatus using an electromagnetic field include a technique of controlling the structure in the process of injecting molten metal into the sleeve (Korean Patent No. 10-0554093, Korean Patent No. 10-0436118), a technique of controlling the structure in a die sleeve for structure control before molten metal injected into the sleeve and moved by a plunger is injected into a die cavity (Korean Patent No. 10-0662034), and a technique of controlling the structure with a structure control module additionally installed on a fixed die plate to expand the space for structure control (Korean Patent No. 10-1253605).

Since the structure control by the electromagnetic field serves to refine the structure of the solid particles by stirring the electromagnetic field in the process of forming the solid phase in the solid-liquid coexistence section of the injected alloy, it has a limitation in maximizing the structure control effect when the injected molten metal is in a completely liquid state above the liquidus as suggested in Korean Patent No. 10-0554093 and Korean Patent No. 10-0436118. The effect of smooth structure control can be achieved in the solid-liquid coexistence section. However, since the temperature of the molten metal is above the liquidus, structure control should be performed with a certain delay time. In addition, after the structure control is performed, the temperature of the molten metal falls into the coexistence section, and accordingly the temperature is not high enough to have sufficient fluidity. Further, when the controlled molten metal is injected into the sleeve, the temperature of the molten metal is further decreased due to the low temperature of the sleeve, and thus the working temperature required for the molten metal injected into the cavity cannot be satisfied.

In addition, when a structure control module is inserted into the die as in the technology disclosed in Korean Patent No. 10-0662034, most of the sleeve fixing parts of the die are removed to secure the position of the structure control module. Accordingly, the die becomes excessively large, and the life of the electromagnetic stirrer, which is arranged to be enclosed by both the surface plate and the die and thus directly subjected to the heat generated from the molten metal, is shortened. In addition, since the strength of the electromagnetic field is limited, it may be difficult to apply the desired electromagnetic field.

Further, as the peripheral areas holding the sleeve are removed to insert the electromagnetic stirrer, the support force of the fixed die or the surface plate around the sleeve may be reduced, which may affect the shape stability and life of the sleeve.

In addition, in increasing the strength of the structure control as disclosed in the Korean Patent No. 10-1253605, a limited space as in Korean Patent No. 10-0662034 is a disadvantage, and thus a space for installing the structure control module may be secured on the fixed die plate. However, as in the case of Korean Patent 10-0662034, if the structure control module is installed inside the equipment receiving a lot of heat, the temperature of the coil module may be increased. Increasing the strength of the structure control module is also limited due to the limited space, and it is very vulnerable in terms of securing a sleeve that induces molten metal injection.

DISCLOSURE

Technical Problem

Therefore, the present disclosure has been made in view of the above problems, and it is one object of the present disclosure to ensure that the installation of an electromagnetic stirring device for controlling the structure of molten metal is achieved by optimally utilizing the space of the die casting apparatus.

It is another object of the present disclosure to provide a die casting apparatus that allows an electromagnetic stirring device to cool itself and parts around the sleeve when the stirring device is operated.

It will be appreciated by persons skilled in the art that the objects that can be achieved with the present disclosure are not limited to what has been particularly described hereinabove and other objects that can be achieved with the present disclosure will be clearly understood by those skilled in the art from the following description.

Technical Solution

In accordance with one aspect of the present disclosure, provided is a die casting apparatus provided with a movable electromagnetically controlled structure control module, including a movable die equipped with a casting space and a lower fixed die arranged to correspond to the movable die to accommodate molten metal and including a sleeve allowing the molten metal to be injected thereinto, wherein the movable die and the lower fixed die are brought into contact with each other to form the molten metal into a cast product. The die casting apparatus includes at least one electromagnetic stirring device accommodation portion formed up to a periphery of the sleeve through the lower fixed die in a penetrating manner so as to electromagnetically stir the molten metal injected through the sleeve, the at least one electromagnetic stirring device accommodation portion accommodating an electromagnetic stirring device therein.

Here, the lower fixed die may include a fixed die contacting the movable die; and a lower plate connected to the fixed die.

The die casting apparatus may further include an electromagnetic stirring device arranged in the electromagnetic stirring device accommodation portion.

The electromagnetic stirring device may include a metal core having a coil wound thereon; a coil surrounding the metal core; and a case configured to store and seal the metal core.

The electromagnetic stirring device may be provided therein with a flow passage allowing a refrigerant or cooling oil to flow therethrough.

Advantageous Effects

A die casting apparatus according to an embodiment of the present disclosure allows an operator to retrieve an electromagnetic stirring device according to a situation to adjust the scale of the electromagnetic field or replace the electromagnetic stirring device. Accordingly, it is possible to adjust the scale of the electromagnetic field.

In addition, the temperature around the sleeve of the die casting apparatus may be controlled through a flow path provided inside the electromagnetic stirring device, thereby improving the life and shape stability of the sleeve.

Further, by enabling temperature control of the electromagnetic stirring device, the life of the stirring device may be improved, and temperature rise suppression by the structure control module may be maximized.

In addition, the strength of the magnetic field may be increased by determining the number of turns and diameter of a coil, which determine the strength of the electromagnetic field in the withdrawal direction. Also, by minimizing the parts of the lower plate and the fixed die to be processed to secure a portion to fix the electromagnetic coil around the sleeve, the cross-sectional area of the metal core may be reduced. Thereby, the sleeve fixing structure may be enhanced.

The effects of the present disclosure are not limited to the effects mentioned above, and other effects not mentioned will become apparent to those skilled in the art from the claims.

BEST MODE

Figure 1:
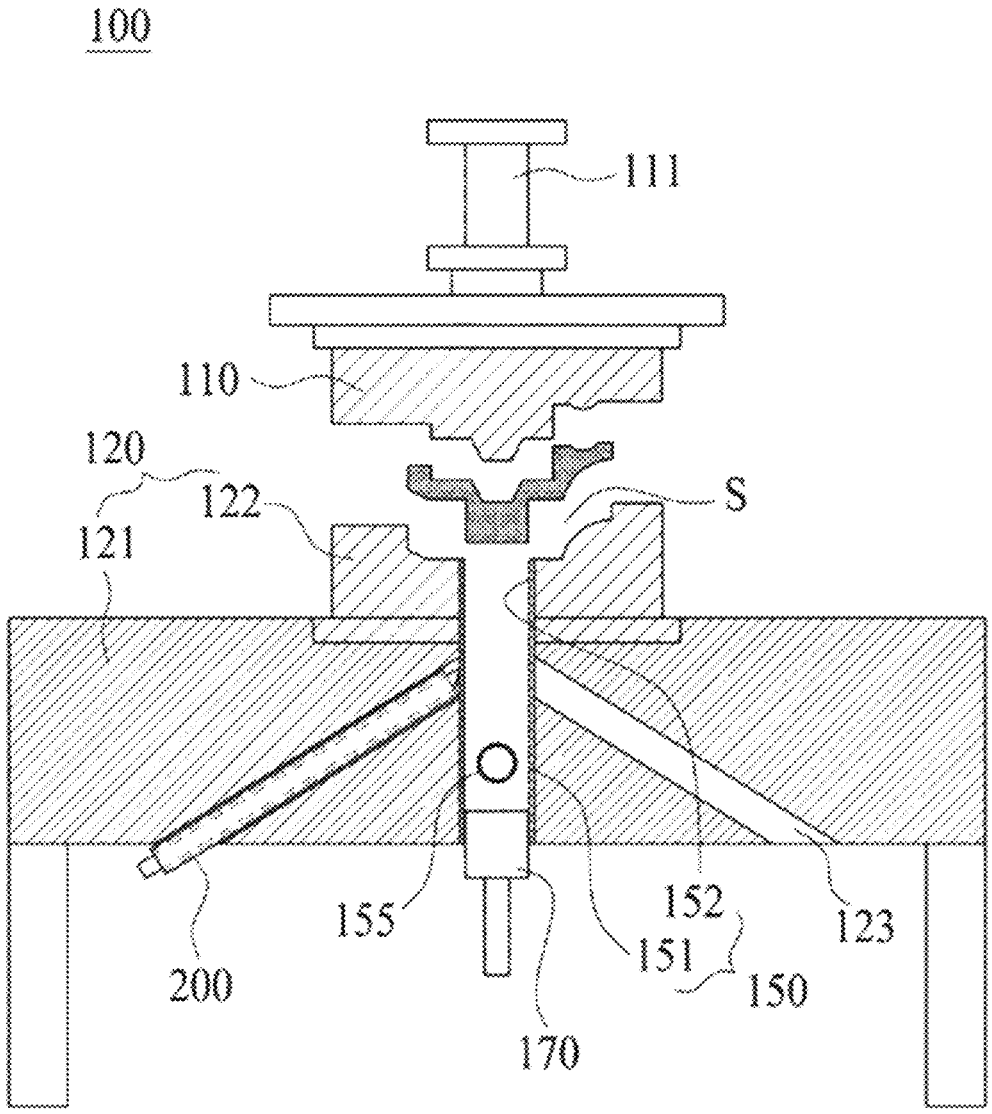
FIG. 1 is a cross-sectional view of a die casting apparatus according to a first embodiment of the present disclosure.

Hereinafter, exemplary embodiments of the present disclosure will be described in detail with reference to the accompanying drawings. The following embodiments are provided as examples to sufficiently convey the idea of the present disclosure to those skilled in the art. Accordingly, the present disclosure is not limited to the embodiments described below and may be embodied in other forms. In addition, in the drawings, the length and thickness of layers and regions may be exaggerated for simplicity. The same reference numerals will be used to refer to the same or like pats throughout the specification.

FIG. 1 is a cross-sectional view of a die casting apparatus according to a first embodiment of the present disclosure. As shown in the figure, the die casting apparatus 100 according to the present embodiment includes a movable die 110 and a lower fixed die 120.

Here, a separate vertical movement member 111 is arranged at the top of the movable die 110 to vertically move the movable die 110.

In addition, a casting space S in which a cast material is processed is defined between contact portions of the movable die 110 and the lower fixed die 120.

In addition, the lower fixed die 120 includes a sleeve 150 serving as a passage through which molten metal moves to the casting space S. The sleeve 150 may be formed as a circular pipe with both ends open and vertically inserted into the central portion of the lower fixed die 120 in a penetrating manner.

A plunger 170 is provided at a lower side of the sleeve 150 to move the molten metal injected into the sleeve 150 into the casting space S.

Further, a molten metal inlet hole 155 is formed at one side of the sleeve 150. Although not shown in the figure, a molten metal injection passage (not shown) is connected to the molten metal inlet hole 155, and is provided with a valve (not shown) to block the molten metal injection passage after a certain amount of molten metal required for die casting is introduced into the sleeve 150 to block the molten metal from being excessively introduced into the sleeve 150. When the plunger rises to increase the pressure inside the sleeve 150, the valve prevents the molten metal inside the sleeve 150 from flowing out along the molten metal injection passage.

The lower fixed die 120 may be divided into a lower plate 121 and a fixed die 122 installed at the top of the lower plate 121. In this case, the fixed die 122 at the upper side is provided with a die sleeve 152 and the lower plate 121 at the lower side is provide with a machine sleeve 151. Both the die sleeve 152 and the machine sleeve 151 are formed of circular pipes with open ends, and are vertically inserted into the central portion of the fixed die 122 and the central portion of the lower plate 121 in a penetrating manner to communicate with each other. The molten metal inlet hole 155 may be formed in either the fixed die 122 or the machine sleeve 151, or may be formed in both.

Accordingly, when the movable die 110 moves toward the fixed die 122 and comes into contact with the fixed die 122, the casting space S is formed. When molten metal is supplied into the die sleeve 152 in the fixed die 122 and the machine sleeve 151 in the lower plate 121, the plunger 170 moves the molten metal accommodated in the die sleeve 152 and the machine sleeve 151 to the casting space to perform die casting.

The lower fixed die 120 is provided with an electromagnetic stirring device accommodation portion 123. The electromagnetic stirring device accommodation portion 123 is a passage for moving an electromagnetic stirring device 200, which will be described later, and is formed to contact the sleeve 150 from the outside of the lower fixed die 120. A single or multiple electromagnetic stirring device accommodation portions 123 may be provided.

Figure 9:
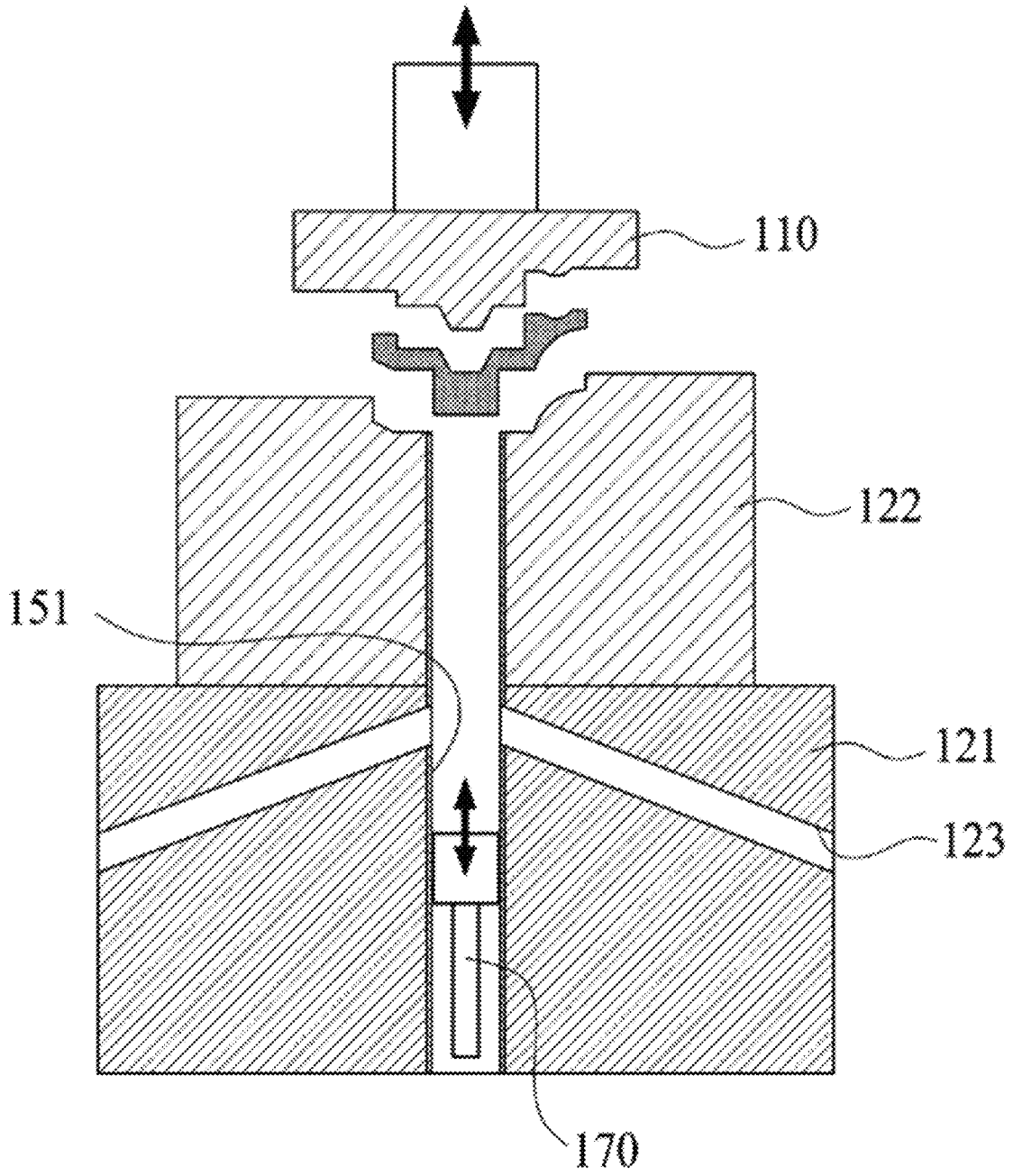
FIG. 9 is a cross-sectional view of the die casting apparatus having an electromagnetic stirring device accommodation portion provided to a lower plate.
Figure 10:
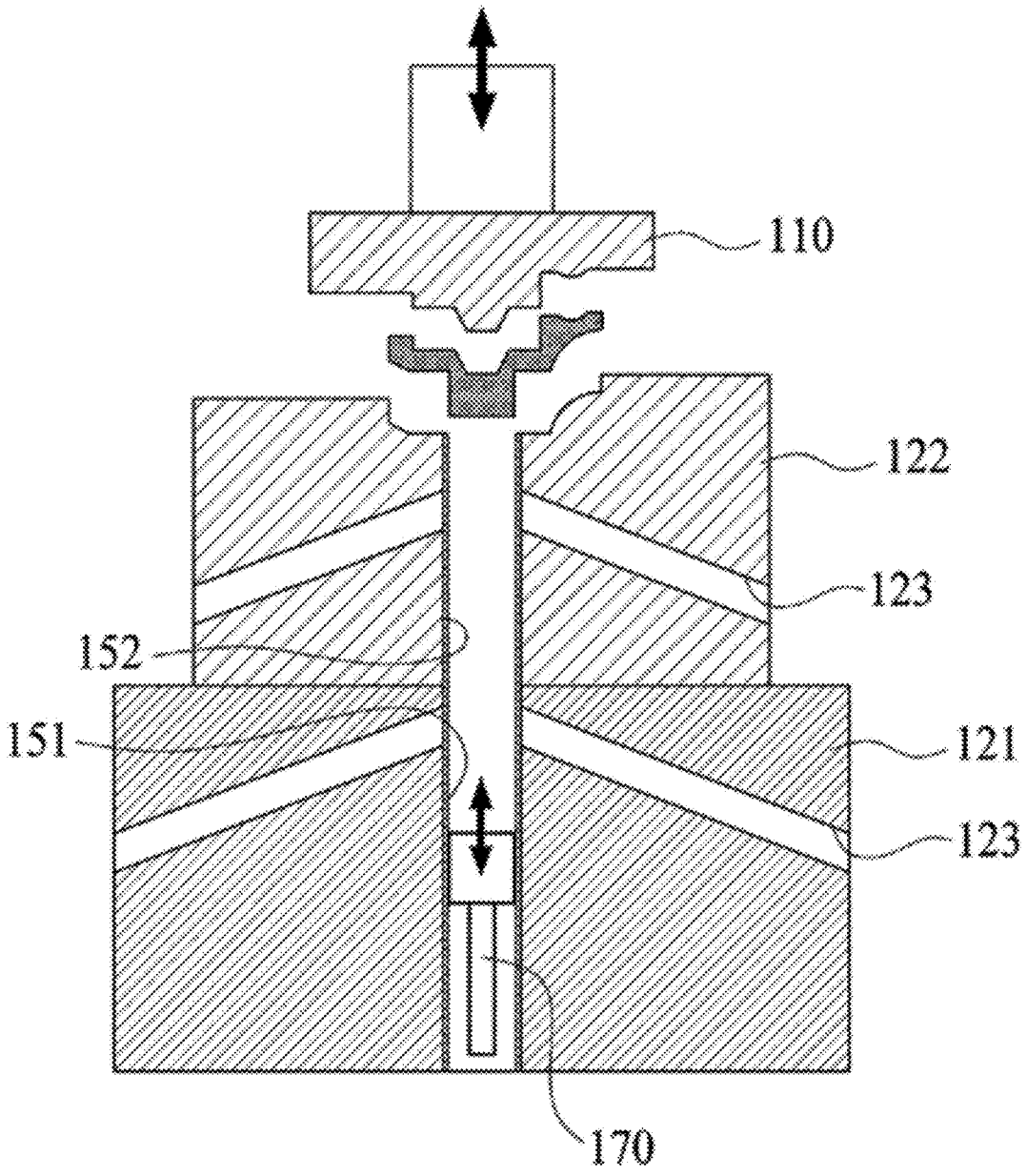
FIG. 10 is a cross-sectional view of the die casting apparatus having an electromagnetic stirring device accommodation portion provided to the fixed die and the lower plate, respectively.

When the lower fixed die 120 is divided into the lower plate 121 and the fixed die 122 installed at the top of the lower plate 121, the electromagnetic stirring device accommodation portion 123 may be formed in the lower plate 121 as shown in FIGS. 1 and 9, may be formed in the fixed die 122 as shown in FIG. 10, or may be formed in both the lower plate 121 and the fixed die 122.

Hereinafter, a case where the electromagnetic stirring device accommodation portion 123 is formed in the lower plate 121, as illustrated in FIGS. 1 and 9, will be described as an example.

Preferably, the electromagnetic stirring device accommodation portion 123 may be radially arranged in the circumferential direction around the machine sleeve 151.

Figure 2:
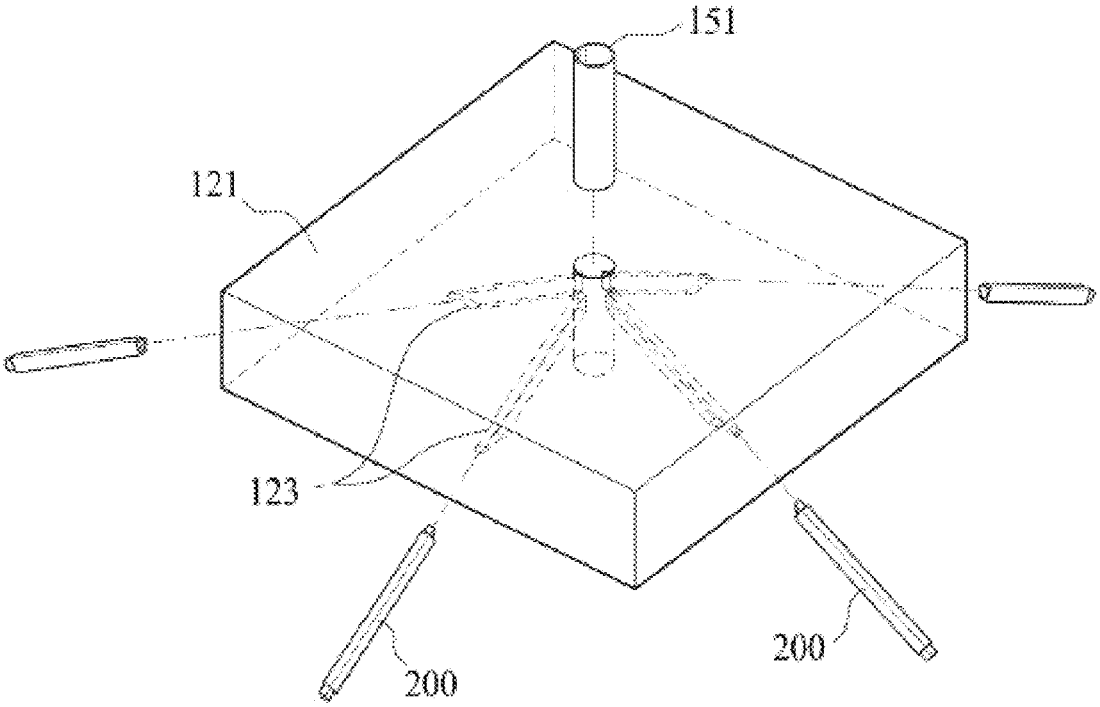
FIG. 2 is an exploded perspective view of main parts including an electromagnetic stirring device.

In this case, as shown in FIG. 2, any number of electromagnetic stirring device accommodation portions 123 may be radially arranged from the center of the cross section of the machine sleeve 151, while forming an arbitrary circumferential angle so as to meet the required characteristics of a final product.

In addition, the circumferential angle of the adjacent electromagnetic stirring device accommodation portion 123 is preferably configured to be constant such that a uniform electromagnetic force acts along the circumference of the machine sleeve 151.

Figure 3:
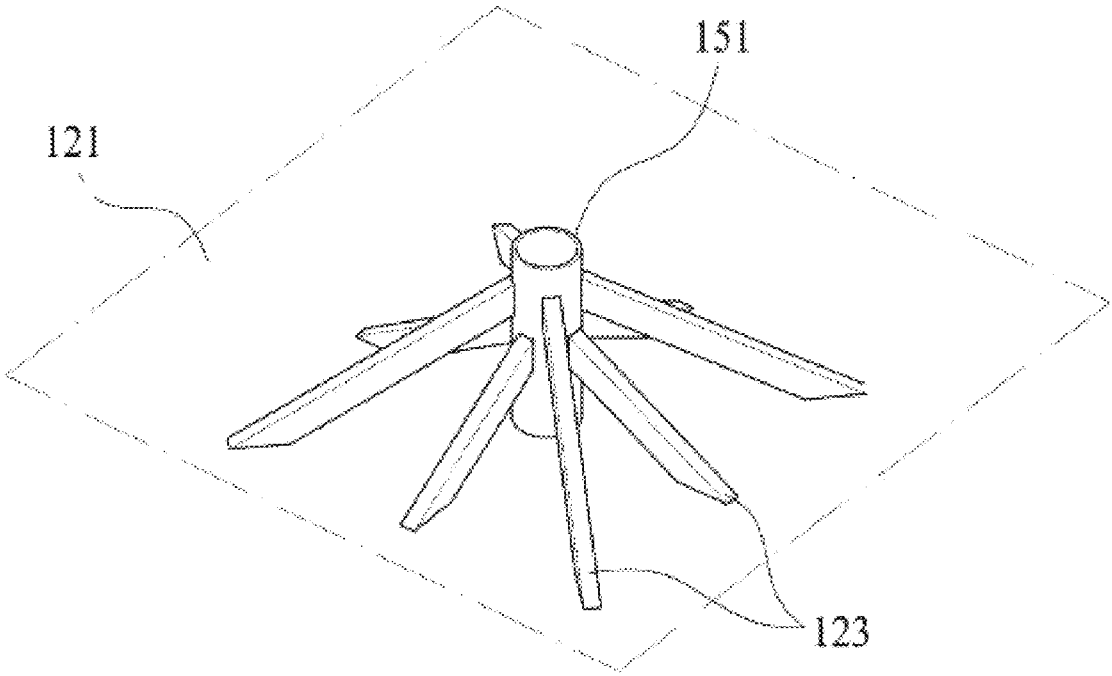
FIG. 3 is a perspective view of main parts including an electromagnetic stirring device accommodation portion formed in multiple layers.

Here, as shown in FIG. 3, a group of a plurality of electromagnetic stirring device accommodation portions 123 may be formed at a first cross-sectional position of the machine sleeve 151, and other electromagnetic stirring device accommodation portions 123 may be installed at other positions of the machine sleeve 151 at a certain distance from the group. That is, in addition to the electromagnetic stirring device accommodation portions 123 formed at the first cross-sectional position of the machine sleeve 151, additional electromagnetic stirring device accommodation portions 123 may be installed at a second cross-sectional position or a third cross-sectional position of the machine sleeve 151.

When the electromagnetic stirring device accommodation portions 123 are formed at several cross-sectional positions of the machine sleeve 151, the electromagnetic stirring device accommodation portions 123 may be arranged at different heights on the machine sleeve 151 while being aligned at the same positions along the outer circumferential surface. Alternatively, the electromagnetic stirring device accommodation portions 123 may be misaligned to be arranged in a zigzag pattern.

When the electromagnetic stirring device accommodation portions 123 are formed on the machine sleeve 151, they may be formed in a direction perpendicular to the central axis of the machine sleeve 151, or may be formed to extend downward or upward at a certain angle in an oblique direction. In this embodiment, the electromagnetic stirring device accommodation portions 123 inclined at a certain angle downward are shown as an example.

The electromagnetic stirring device 200 accommodated in the electromagnetic stirring device accommodation portion 123 includes an inner metal core body 232 in which a coil is wound, and a case 234 for accommodating the metal core body 232.

In this case, the metal core body 232 may include one or more cooling flow passages 201 and 202 formed therethrough in a longitudinal direction. The cooling flow passages 201 and 202 contain a refrigerant or cooling oil to reduce the temperature of the electromagnetic stirring device 200 in the fixed die 122.

In addition, two or more of the cooling flow passages 201 and 202 may be applied in various forms to facilitate introduction and extraction of the cooling oil.

The design may be changed such that the cooling oil circulates in the metal core body 232 through the cooling flow passages 201 and 202.

Figure 7:
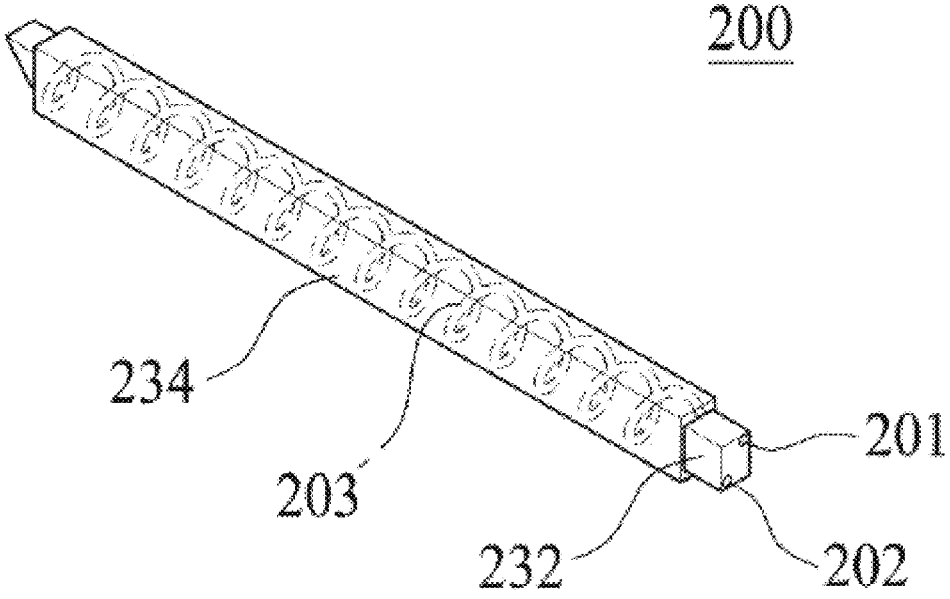
FIG. 7 is a perspective view of an electromagnetic stirring device provided with a spiral cooling channel.
Figure 8:
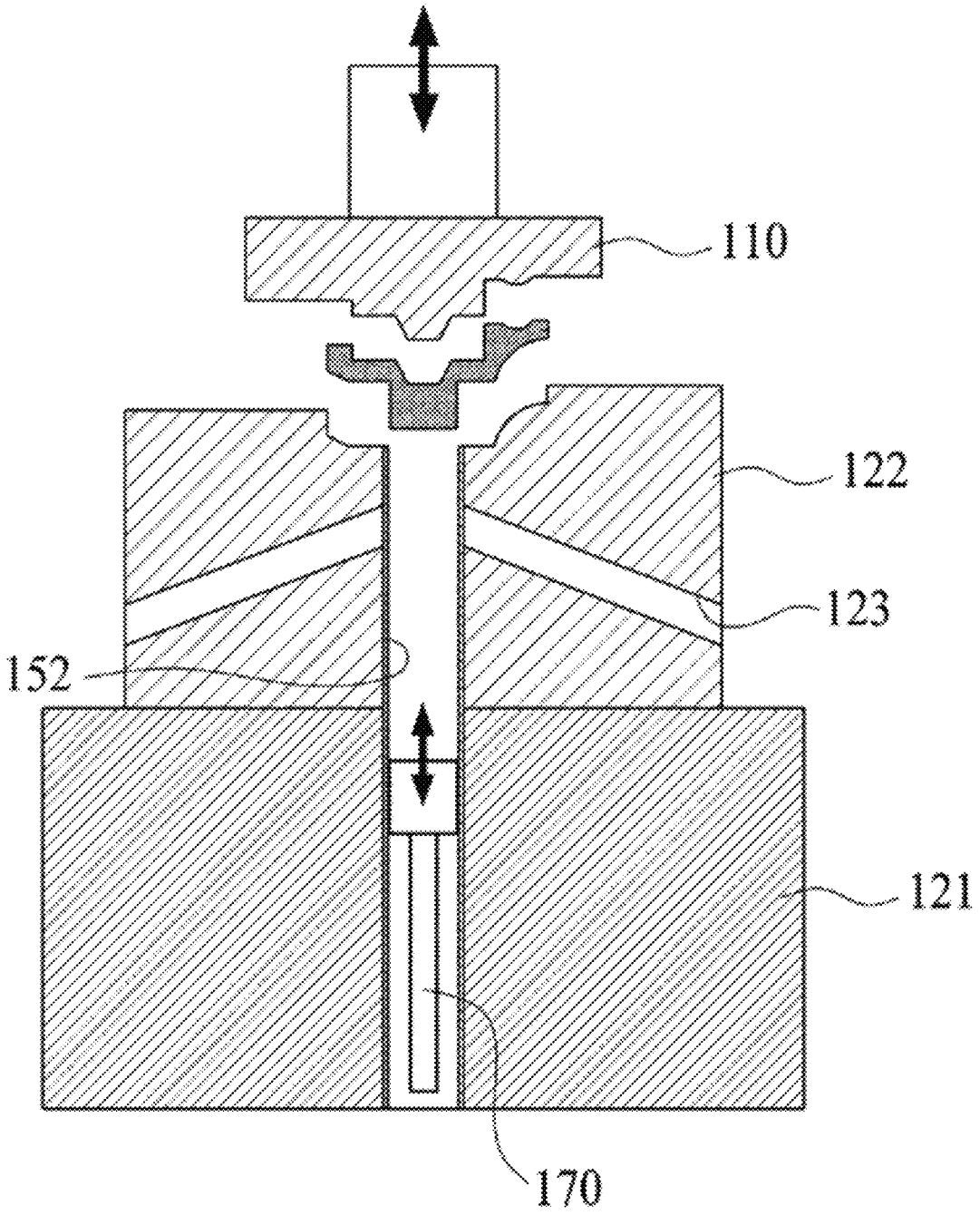
FIG. 8 is a cross-sectional view of a die casting apparatus having an electromagnetic stirring device accommodation portion provided to a fixed die.

In addition, as shown in FIG. 7, the electromagnetic stirring device 200 may take the form of a circulating spiral cooling flow passage 203 spirally wound on the outer surface of the metal core body 232 or the outer surface of the case 234 to double the cooling efficiency.

Figure 4:
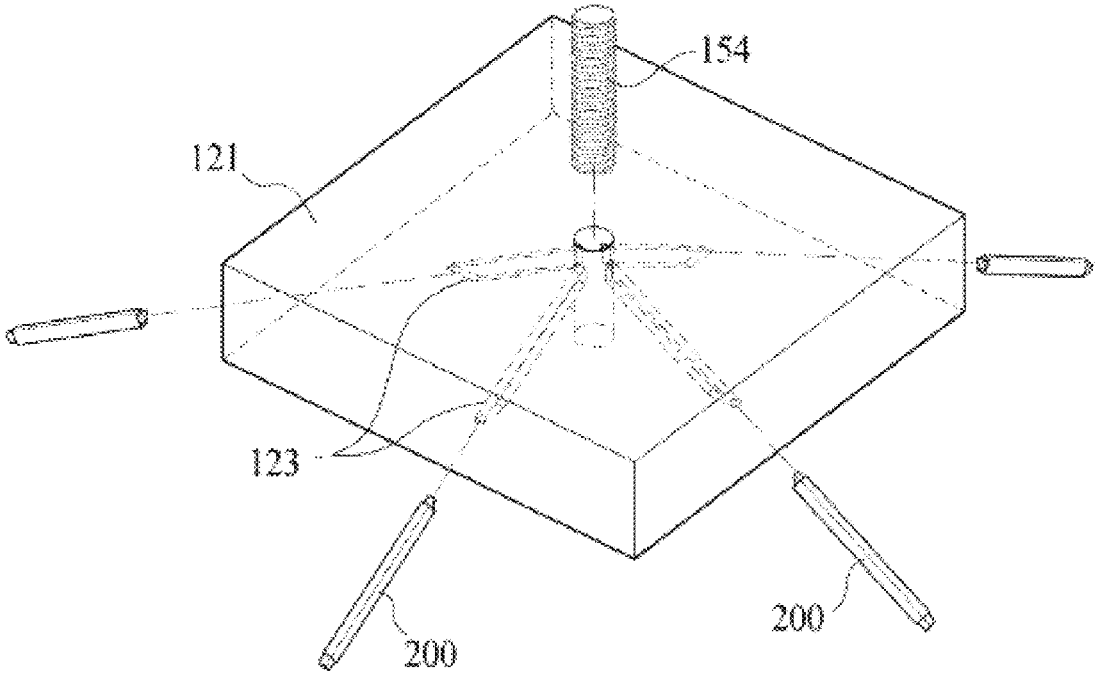
FIG. 4 is a perspective view of main parts including a sleeve provided with a cooling flow path.
Figure 5:
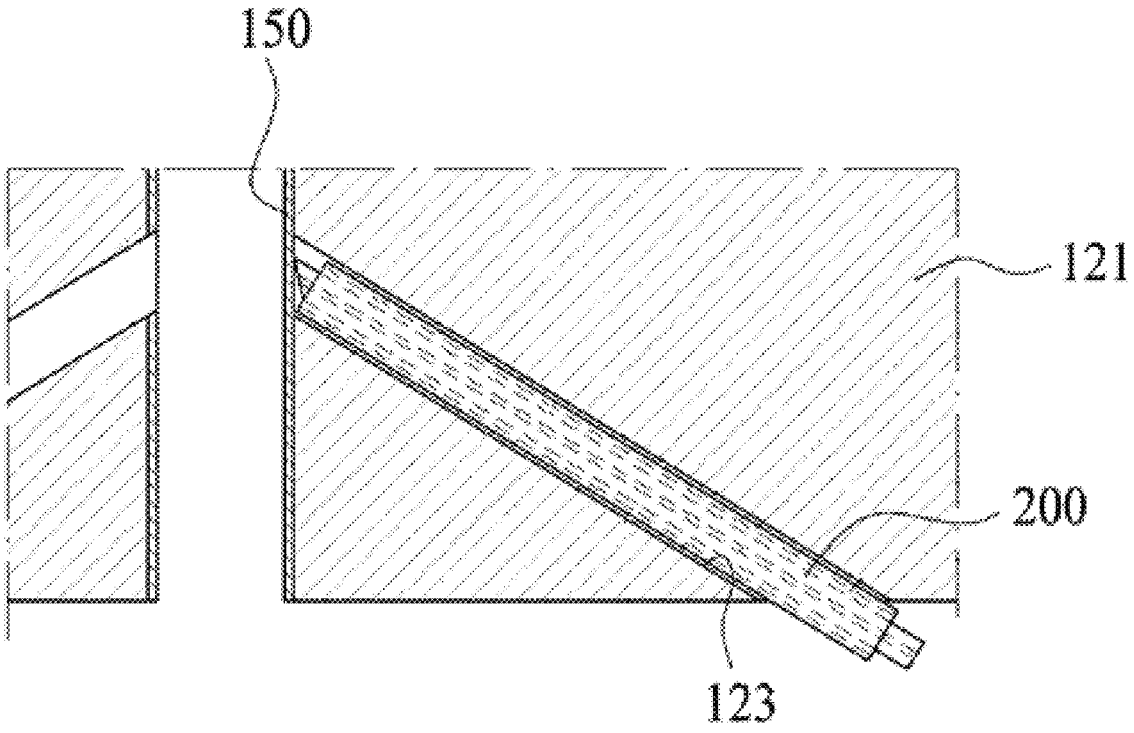
FIG. 5 is a cross-sectional view of main parts of a lower fixed die including an electromagnetic stirring device.
Figure 6:
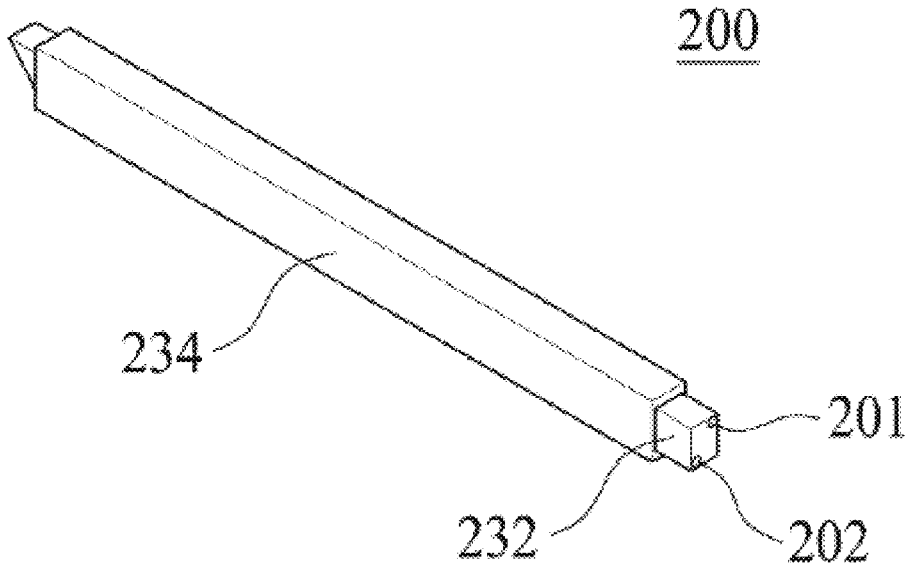
FIG. 6 is a perspective view of an electromagnetic stirring device.

Further, as shown in FIG. 4, a spiral sleeve cooling flow passage 154 may be formed on the outer circumferential surface of the machine sleeve 151. In this case, the sleeve cooling flow passage 154 communicates with the cooling flow passages 201 and 202 of the electromagnetic stirring device 200 to serve as a passage of the cooling oil flowing through the cooling flow passages 201 and 202. In this case, since the cooling oil circulates along the outer circumferential surface of the machine sleeve 151, cooling efficiency around the sleeve may be maximized.

Although not shown in the figure, the sleeve cooling flow passage 154 may also be provided in the die sleeve 152.

In addition, in order to maximize the effect of electromagnetic stirring, a separate extended fixed die and an extended fixed sleeve arranged through the central portion of the extended fixed die may be provided between the fixed die 122 and the lower plate 121. The electromagnetic stirring device 200 may also be additionally installed adjacent to the extended fixed sleeve.

The electromagnetic stirring device 200 configured as described above is connected to a power source to form an electromagnetic field, thereby inducing electromagnetic stirring therearound to induce stirring of the molten metal. Thereby, the structure of the molten metal may be controlled. The electromagnetic stirring device 200 may be connected to a power source for forming an electromagnetic field.

In addition, the electromagnetic stirring device 200 may be inserted into the lower plate 121 through the electromagnetic stirring device accommodation portion 123 toward a portion adjacent to the machine sleeve 151, and may be withdrawn therefrom.

Therefore, when the electromagnetic stirring device 200 is heated due to the high temperature of the molten metal or the electromagnetic stirring device 200 is heated by the heat generated by the electromagnetic field, the electromagnetic stirring device 200 may be drawn out and air-cooled or may be cooled by circulating cooling oil. Thereby, the life of the electromagnetic stirring device 200 may be improved. Through this process, heat affecting the sleeve 150 may be reduced, and thus the integrity of the sleeve 150 may be maintained.

Figure 11:
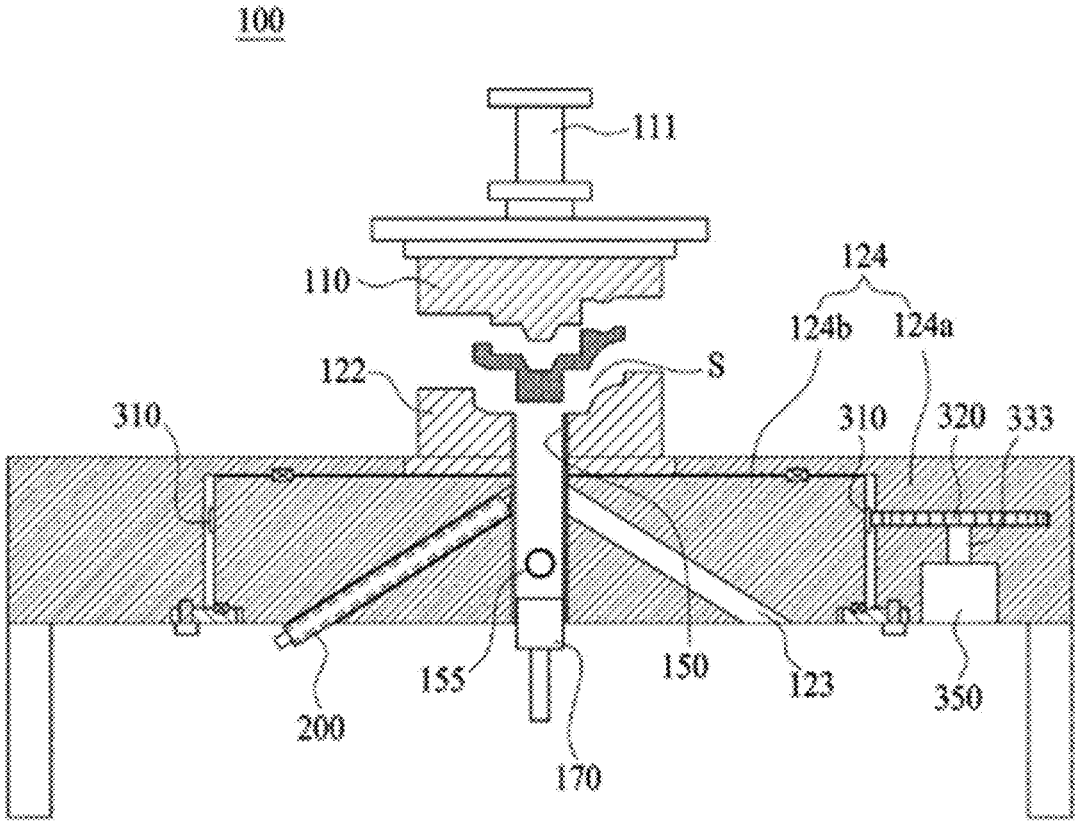
FIG. 11 is a cross-sectional view of a die casting apparatus according to a second embodiment of the present disclosure.

FIG. 11 is a cross-sectional view of a die casting apparatus 100 according to a second embodiment of the present disclosure, wherein the lower plate 124 may include a fixed body 124*a* on which a fixed die 122 is installed, and a rotary part 124*b* configured to rotate around a sleeve 150.

The rotary part 124*b* is formed in a circular block shape including an electromagnetic stirring device accommodation portion 123 and is accommodated inside the fixed body 124*a*. The sleeve 150 is inserted into the center of the rotary part 124*b*.

In addition, a motor 350 is provided in the fixed body 124*a*, and a first gear 310 and a second gear 320 rotatably engaged with a rotation shaft 333 of the motor 350 and an outer circumferential surface of the rotary part 124*b* are provided. The first gear 310 is arranged on the outer circumferential surface of the rotary part 124*b*, and the second gear 320 is arranged on the rotation shaft 333 of the motor 350 so as to be engaged with the first gear 310.

In addition, a bearing is provided between the fixed body 124*a* and the rotary part 124*b* to assist smooth rotation of the rotary part 124*b*.

Accordingly, when molten metal flows into the sleeve 150, the motor 350 is operated, and the rotational power of the motor 350 is transmitted to the rotary part 124*b* through the first gear 310 and the second gear 320. Then, the rotary part 124*b* will rotate around the sleeve 150.

When the rotary part 124*b* rotates, the electromagnetic stirring device accommodation portion 123 and the electromagnetic stirring device 200 arranged in the rotary part 124*b* are rotated together around the sleeve 150. Accordingly, the stirring operation may effectively occur throughout the outer circumferential surface of the sleeve 150. Thereby, a die-cast product of a higher quality may be obtained.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

Figure 12:
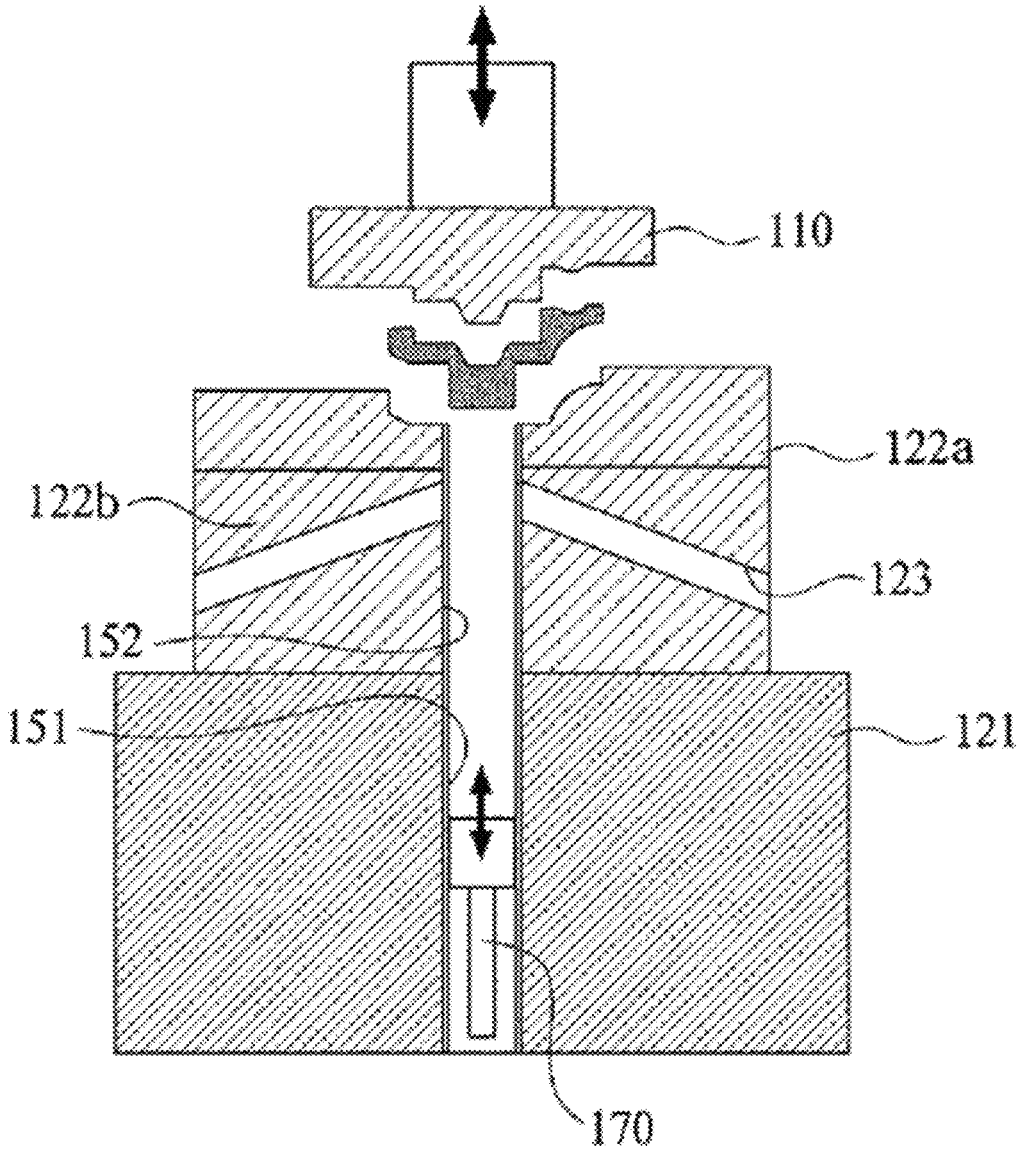
FIG. 12 is a cross-sectional view of a die casting apparatus according to a third embodiment of the present disclosure.

For example, as shown in FIG. 12, after configuring the fixed die 122 with an upper die 122*a* and a lower die 122*b* fixedly installed at the top of the lower plate 121, the electromagnetic stirring device accommodation portion 123 may be applied to the lower die 122*b*. Even in this case, the electromagnetic stirring device accommodation portion 123 may be applied to either the upper die 122*a* or the lower plate 121.

LIST OF REFERENCE NUMERALS

100: Die casting apparatus 110: Movable die
120: Lower fixed die 121: Lower plate
122: Fixed die 123: Electromagnetic stirring device accommodation portion
150: Sleeve 200: Electromagnetic stirring device
201, 202: Cooling flow passage 232: Metal core
234: Case

The invention claimed is:

1. A die casting apparatus provided with a movable electromagnetically controlled structure control module, including a movable die equipped with a casting space and a lower fixed die arranged to correspond to the movable die to accommodate molten metal and including a sleeve allowing the molten metal to be injected thereinto, wherein the movable die and the lower fixed die are brought into contact with each other to form the molten metal into a cast product, the die casting apparatus comprising:

at least one electromagnetic stirring device accommodation portion formed up to a periphery of the sleeve through the lower fixed die in a penetrating manner so as to electromagnetically stir the molten metal injected through the sleeve; and an electromagnetic stirring device arranged in the at least one electromagnetic stirring device accommodation portion, wherein the at least one electromagnetic stirring device accommodation portion is opened at one end thereof, and formed to extend downward or upward at a predetermined angle in an oblique direction with respect to a central axis of the sleeve while extending in a radial direction from the sleeve such that the electromagnetic stirring device is retrieved from the at least one electromagnetic stirring device accommodation portion to adjust a scale of an electromagnetic field or replace the electromagnetic stirring device, and wherein the electromagnetic stirring device comprises:

a metal core having a coil wound thereon; and a case configured to store and seal the metal core.

2. The die casting apparatus of claim 1, wherein the lower fixed die comprises:

a fixed die contacting the movable die; and a lower plate connected to the fixed die.

3. The die casting apparatus of claim 1, wherein the electromagnetic stirring device is provided therein with a flow passage allowing a refrigerant or cooling oil to flow therethrough.

* * * * *